US005600856A

United States Patent [19]

Kang

[11] Patent Number: 5,600,856

[45] Date of Patent: Feb. 11, 1997

[54] TOILET BLOCKAGE REMOVER

[76] Inventor: Kyung T. Kang, 1616 Victory Blvd., Suite 103, Glendale, Calif. 91201

[21] Appl. No.: 541,149

[22] Filed: Oct. 11, 1995

[51] Int. Cl.[6] ..... E03D 9/00

[52] U.S. Cl. ..... 4/255.01; 4/255.11; 417/437

[58] Field of Search ..... 4/253, 255.01, 4/255.02, 255.03, 255.04, 255.05, 255.06, 255.07, 255.08, 255.09, 255.1, 255.11, 255.12; 417/479, 480, 437

[56] References Cited

U.S. PATENT DOCUMENTS

| | | | |
|---|---|---|---|
| 679,007 | 7/1901 | Senff . | |
| 706,869 | 8/1902 | Woodruff . | |
| 733,787 | 7/1903 | Woodruff . | |
| 1,575,102 | 3/1926 | Fiset . | |
| 2,529,587 | 11/1950 | Bates et al. . | |
| 3,346,888 | 10/1967 | Paysinger | 4/253 |
| 4,112,527 | 9/1978 | Giubilo | 4/253 |
| 4,458,368 | 7/1984 | Webb . | |
| 4,831,669 | 3/1989 | Edwards . | |
| 4,922,555 | 5/1990 | Bonilla et al. . | |

*Primary Examiner*—David J. Walczak
*Attorney, Agent, or Firm*—Law Offices of John K. Park & Associates

[57] ABSTRACT

A toilet blockage remover (17) is provided in three selected versions. The first version (21) includes a toilet bowl cover (19) attached to a soft pad (23). The second version (43) includes a pump (47) attached to a soft pad (45) wherein the soft pad (45) has a cutout (49) forming a thru-hole (51). The third version (61) includes a toilet bowl cover (19), a soft pad (23) attached to the toilet bowl cover (19), and the pump (47) attached to the toilet bowl cover (19). The toilet bowl cover (19) and the soft pad (23) of the third version (61) have cutouts (49) forming a thru-hole (51) of the toilet bowl cover (19) and a thru-hole (51) of the soft pad (23). The invention utilizes a substantially air tight seal of air tightness (35) between the pad (23, 45) and the mouth of the toilet opening (33) when the pad (23, 45) is placed upon the mouth of the toilet opening (33). Thereupon the water is flushed to increase the air pressure in the toilet bowl (41) which pushes the blockage away. The addition of the pump (47) enhances the efficiency of the invention by proving a means to give a shock or an impulse of the air, wherein the air within the toilet bowl (41) transmits the shock to the water surface within the toilet bowl (41), and the water transmits the shock to the blockage and the blockage is pushed away removing the clog.

14 Claims, 5 Drawing Sheets

17

TOILET BLOCKAGE REMOVER

BACKGROUND

This invention relates to a new and innovative apparatus of a toilet blockage remover such that this invention eliminates the need of a plunger and the splashing of water or similar liquid material from the toilet bowl when unclogging the toilet using a combination of a plunger and a pump attached on one end.

The use of a pump to push through or to dislodge a blockage to unclog the toilet has been generally known. However, most, if not all, of these pumps have been attached to a long plunger. Such a combination of a plunger and a pump attached to one end is generally known as a "plumber's helper."

The use of a plumber's helper is often associated with two problems. The first problem is that the use of a plumber's helper often unnecessarily splashes water or similar liquid material from the toilet bowl. The second problem is that the use of a plumber's helper is often difficult as the pump attached at an end of the plunger fails to provide a good seal between the pump and the water outlet near the bottom of the toilet bowl.

One or more of the prior art dealt with the first problem of splashing water by providing a cover, a commode, or a shield with a small hole to prevent the water or dirty liquid from spilling over the toilet bowl. The use of the shield or the commode reduced the spilling and the splashing of the liquid, but the plunger portion of the plumber's helper had to be manipulated through a small hole which makes getting the good seal around the water outlet near the bottom of the toilet bowl more difficult. Moreover, the use of the shield or the commode did not allow the user to see the pump portion of the plumber's helper, requiring blind operation underneath the shield, which often made the use very time consuming and inefficient.

Another form of prior art tried to deal with the splashing, but it generally required clamping down a cover over the toilet bowl using mechanical clamps, nuts and bolts, and other fastening devices which made it very bulky and heavy, making it very difficult to be used by children or women. Moreover, one prior art even required a combination of an extended a pump-cylinder with attached piston and a piston rod, and a flat disk-shaped packing on the exterior of the cylinder. This prior art hoped to somehow provide a water-tight seal around the water outlet near the bottom of the toilet bowl. The requiring of many parts, many of which are moving parts, made the use of this prior art very bulky, heavy and inefficient, and made it very difficult to be used by children or women.

For the foregoing reasons, there is a need for a toilet blockage remover that eliminates the need of a plunger and the splashing of water or similar liquid material from the toilet bowl, and which is simple and efficient so even children could conveniently use.

SUMMARY

The present invention is directed to a toilet blockage remover which eliminates the need of a plunger and the splashing of water or similar liquid material from the toilet bowl, and which is simple and efficient to use so even children could conveniently use.

The first version of the present invention comprises a toilet bowl cover and a soft pad. The toilet bowl cover has a top side and a bottom side, and the soft pad has an upper face and a lower face. The upper face of the soft pad is attached to the bottom side of the toilet bowl cover. An ideal way to attach the upper face of the soft pad to the bottom side of the toilet bowl cover is to bond two surfaces together using an adhesive, but any other method to tightly secure two surfaces together would be acceptable.

In this version of the invention, the soft pad is made of substantially softer material than the toilet bowl cover. It is because the soft pad is to be placed over a mouth of a toilet opening with the lower face of the soft pad completely covering the mouth of the toilet opening so that a substantial seal of air tightness is created between the mouth of the toilet opening and the lower face of the soft pad. Therefore, in selecting the material for the soft pad, the air impermeability and the softness are two factors to consider. An ideal material is a soft foam pad or dense sponge that is cut to a size larger than the mouth of a toilet opening. However, the invention is not be limited to the use of the material specified as the only acceptable material.

The toilet bowl cover should be made of stiffer material so it would be able to support the weight that may be placed upon it in order to enhance the efficiency of the invention. A piece of plastic or wood in a shape of the toilet bowl opening would be adequate, but the invention is not be limited to the use of plastic or wood as the only acceptable material. Moreover, different shapes of the toilet bowl cover may also be used.

To enhance the air tightness of the seal between the soft pad and the mouth of the toilet opening, additional weight can be place on the top side of the toilet bowl cover. The weight placed on the top side of the toilet seat cover could be anything that would increase the downward pressure on the soft pad evenly. A heavy book or a several books would be effective. However, the most preferred method is to have the user of the invention simply sit on the invention to supply the additional weight.

The invention is to be used while the toilet water is being flushed. Therefore, the most preferred method in using the invention is to have the user place the invention on the mouth of the toilet opening to completely cover the opening, then the user sits on the invention, and then the user flushes the water. As the air pressure within the toilet bowl increases as the water level rises, the blockage will be pushed away, removing the clog.

The second version of the invention comprises a soft pad with an upper face and a lower face. The soft pad also has a cutout through the pad to form a thru-hole. Then a pump having an inner wall, an outer wall, and a rim is attached to the upper face of the pad. The pump is placed so the pump completely covers over the cutout of the soft pad, so the inner wall of the pump and the upper face of the soft pad covered under the pump creates a cavity which has a thru-hole through the soft pad.

In this second version of the invention, the soft pad is made of soft material that can provide a substantial seal of air tightness between the mouth of the toilet opening and the lower face of the soft pad, and can provide structural support for additional weight to be placed on the invention. Therefore, in selecting the material for the soft pad, the air impermeability and the material strength are two factors to consider. An ideal material is a nylon or plastic foam soft pad that is cut to a size larger than the mouth of a toilet opening. However, the invention is not be limited to the use of the material specified as the only acceptable material.

One preferred improvement in the second version of the invention is that the soft pad can be treated on the upper face of the soft pad so the upper face of the soft pad will have substantially less softness than a portion of the lower face of the soft pad. An example of such a treatment may be using heat, chemical, or radiation to harden the material on and near the upper face of the soft pad. It is believed that when a nylon foam soft pad is heat treated on one side, that side will become harder and stiffer than the untreated side.

Another means to make the soft pad soft on one side and less soft on another side may be the use of the sputtering process. As the material is vapor deposited to form the soft pad, the initially deposited material may be of more softness than the later deposited material. Another means is that as the material is vapor deposited to form the soft pad, the pressure used to deposit the initially deposited material may be less than the pressure used to deposit the later deposited material. Another method is that the pressure and the material may vary during the vapor depositing process so the softness of the soft pad will vary smoothly across the thickness of the pad. The use of the sputtering technique is only one commonly known process that is able to provide a pad with two different softness within a single pad, and the invention is not be limited to the use of the process specified as the only acceptable method.

To enhance the air tightness of the seal between the soft pad and the mouth of the toilet opening, additional weight can be placed on the upper face of the soft pad. The weight placed on the upper face of the soft pad could be anything that would increase the downward pressure on the invention evenly on and around the mouth of the toilet opening. The preferred form of the weight to be used will be those weights which have structural base wider than the opening of the mouth of the toilet opening so the weight is distributed around the mouth of the toilet. If such weight with wide base is not available, then a hard board such as a wood panel may be placed on the soft pad before the weight is placed. A preferred method is to have the user of the invention simply sit on the invention to supply the additional weight while using thighs to distribute most of body weight on to the mouth of the toilet opening.

The invention is to be used while the toilet water is being flushed. Therefore, a preferred method in using the invention is to have the user place the invention on the mouth of the toilet opening to completely cover the opening, then the user sits on the invention, then the user flushes the water, and then the user pumps the pump several times while the water is filling the toilet bowl. As the air pressure within the toilet bowl increases as the water level rises, and the air within the toilet bowl is suddenly pushed and agitated in order to generate a shock wave of the pumping action, the impact of the air shock wave will be transmitted and will push the blockage away to remove the clog.

The third version of the invention comprises a toilet bowl cover, a soft pad, and a pump attached to the top side of the toilet bowl cover. The toilet seat cover has a top side and a bottom side, the soft pad has an upper face and a lower face, and the pump has an inner wall, an outer wall, and a rim. The toilet bowl cover has a thru-hole and the soft pad has a thru-hole, wherein the thru-hole of the cover substantially overlaps with the thru-hole of the soft pad.

The upper face of the soft pad is attached to the bottom side of the toilet bowl cover. An ideal means to attach the upper face of the soft pad to the bottom side of the toilet bowl cover is to bond two surfaces together using an adhesive, but any other method to tightly secure two surfaces together will be acceptable.

The pump is attached to the top side of the toilet bowl cover so the pump completely covers over the cutout of the toilet bowl cover. The inner wall of the pump and the top side of the toilet bowl cover covered under the pump creates a cavity which has an opening through the toilet bowl cover and through the soft pad.

In this version of the invention, the soft pad is made of substantially softer material than the toilet seat cover. It is because the soft pad is to be placed over a mouth of a toilet opening with the lower face of the soft pad completely covering the mouth of the toilet opening so that a substantial seal of air tightness is created between the mouth of the toilet opening and the lower face of the soft pad. Therefore, in selecting the material for the soft pad, the air impermeability and the softness are two factors to consider. An ideal material is a soft foam or dense sponge that is cut to a size larger than the mouth of a toilet opening. However, the invention is not be limited to the use of the material specified as the only acceptable material.

The toilet bowl cover should be made of stiffer material so it would be able to support any additional weight that may be placed upon it to enhance the efficiency of the invention. A piece of plastic or wood in a shape of the toilet bowl opening would be adequate, but the invention is not to be limited to the use of plastic or wood as the only acceptable material.

To enhance the air tightness of the seal between the soft pad and the mouth of the toilet opening, an additional weight can be placed on the top side of the toilet bowl cover. The weight placed on the top side of the toilet bowl cover could be anything that would increase the downward pressure on the invention evenly. A heavy book or a several books would be effective. However, the most preferred method is to have the user of the invention simply sit on the invention to supply the additional weight.

The invention is to be used while the toilet water is being flushed. Therefore, the most preferred method in using the invention is to have the user places the invention on the mouth of the toilet opening to completely cover the opening, then the user sits on the invention, then the user flushes the water, and then the user pumps the pump several times while the water is filling the toilet bowl. As the air pressure within the toilet bowl increases as the water level rises, and the air within the toilet bowl is suddenly pushed and agitated in order to generate a shock wave of the pumping action, the impact of the air shock wave will be transmitted and will push the blockage away to remove the clog.

With the second version and the third version of this invention, if the pump is made of a material without sufficient elasticity, such as soft rubber, then the pump can be used as the indicator that shows whether the blockage is removed or not. Because the invention works due to the increased pressure within the toilet bowl as the water is flushed and fills the toilet bowl, once the blockage is removed, then the air pressure in the toilet bowl returns to the normal atmospheric pressure. Therefore, if the pump is made of flexible material which does not return to its original shape unless pressure is applied, then the result is that while the pressure is built up because of the blockage, the increased pressure within the toilet bowl will push the pump outward to its original shape, and while the pressure is relieved because of the blockage is removed, the normalized pressure within the toilet bowl will not be able to push the pump outward to its original shape. Therefore, as the water is flushed, and while the pressure is built up, the pump will be restored to its original shape so the user may pump again, but as the blockage is removed and the pressure is normalized, the pump will not return to its original shape, signaling the removal of the clog.

One of the advantages in using this invention is the simplicity. There are no clamps, fastening devices, a cover with a hole for the plunger, and a pump attached to an end of a long plunger. With one version of the invention, the user simply places the invention over a toilet bowl with a clog, and flush the water. With the second and the third versions of the invention, the user simply places the invention over a toilet bowl with a blockage, flushes the water, and pumps the pump a several times as water accumulates within the toilet bowl. It is that simple.

Another advantage in using this invention is that it is clean. Because there is no agitation of the water by the pump which is immersed, the splashes are controlled and are very limited. Because splashes are controlled, there are no mess. Even the cleaning of the invention after the use is often unnecessary as much of the water does not splash and does not touch the invention.

DRAWINGS

These and other features, aspects, and advantages of the present invention will become better understood with regard to the following description, appended claims, and accompanying drawings where:

DESCRIPTION

With reference to the figures, a toilet blockage remover 17 according to the present invention is illustrated. The figures illustrate three versions of the present invention.

Figure 2:
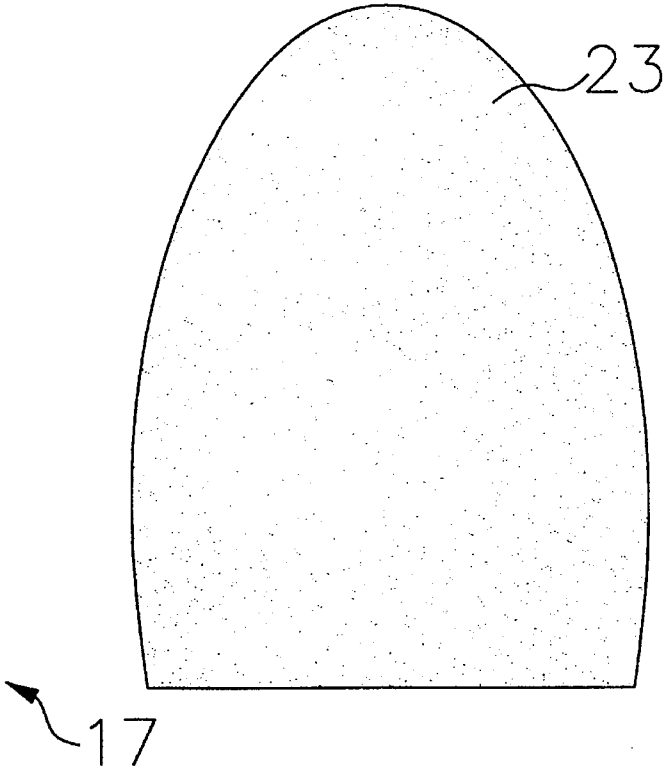
FIG. 2 is rear view of the first version of the present invention.
Figure 1:
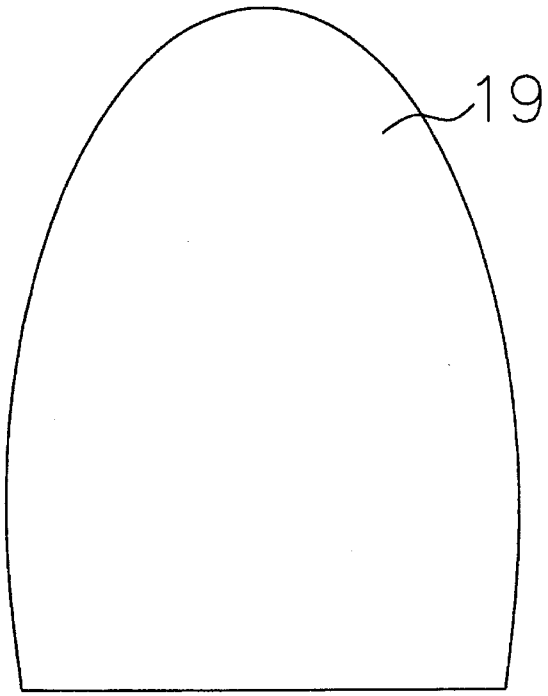
FIG. 1 is a front view of the first version of the present invention.
Figure 3:
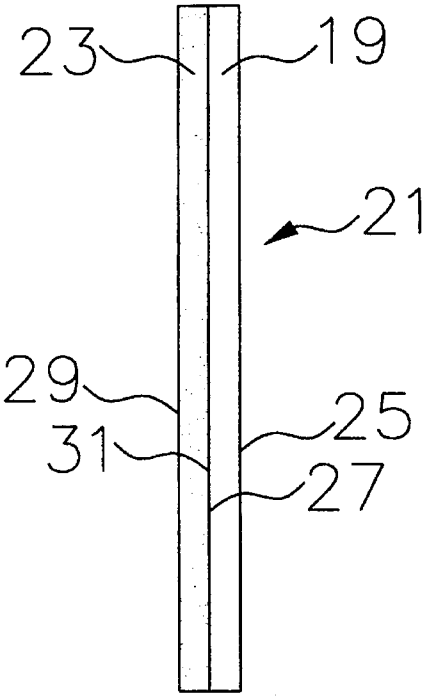
FIG. 3 is a side view of the first version of the present invention.

FIG. 1 shows a toilet bowl cover 19 of the first version 21 of the toilet blockage remover 17. FIG. 2 shows a soft pad 23 of the first version of the toilet blockage remover 17. FIG. 3 shows the toilet bowl cover 19 with a top side 25 and a bottom side 27, and the soft pad 23 with a lower face 29 and an upper face 31.

The upper face 31 of the soft pad 23 is attached to the bottom side 27 of the toilet bowl cover 19. An ideal means to attach the upper face 31 of the soft pad 23 to the bottom side 27 of the toilet bowl cover 19 is to bond the upper face 31 and the bottom side 27 together using an adhesive, but any other method to tightly secure two surfaces together would be acceptable.

In the first version 21, the soft pad 23 is made of substantially softer material than the toilet bowl cover 19. It is because the soft pad 23 is to be placed over a mouth of a toilet opening 33 with the lower face 29 of the soft pad 23 completely covering the mouth of the toilet opening 33 so that a substantial seal of air tightness 35 is created between the mouth of the toilet opening 33 and the lower face 29 of the soft pad 23. Therefore, in selecting the material for the soft pad 23, the air impermeability and the softness are two factors to consider. An ideal material is a soft foam or dense sponge that is cut to a size larger than the mouth of a toilet opening 33. However, the first version 21 of the invention is not be limited to the use of the material specified as the only acceptable material.

The toilet bowl cover 19 should be made of stiffer material so it would be able to support the weight that may be placed upon it in order to enhance the efficiency of the invention. A piece of plastic or wood in a shape of the toilet seat 37 would be adequate, but the invention is not be limited to the use of plastic or wood as the only acceptable material. Moreover, different shapes of the toilet bowl cover 19 may also be used, not limited to the shape of the toilet seat cover 19 or the shape of the toilet seat 37.

To enhance the air tightness of the seal of air tightness 35 between the soft pad 23 and the mouth of the toilet opening 33, additional weight can be placed on the top side of the toilet seat cover. The weight placed on the top side of the toilet seat cover could be anything that would increase the downward pressure on the soft pad 23 evenly on and around the mouth of the toilet opening 33. A heavy book or a several books would be effective. However, the most preferred method is to have the user 39 of the invention simply sit on the invention to supply the additional weight.

The first version 21 of the invention is to be used while the toilet water is being flushed. Therefore, the most preferred method in using the invention is to have the user 39 place the first version 21 of the invention on the mouth of the toilet opening 33 to completely cover the mouth of the toilet opening 33, then the user 39 sits on the first version 21, and then the user 39 flushes the water. As the air pressure within the toilet bowl 41 increases as the water level rises, the blockage will be pushed away, removing the clog.

Figure 5:
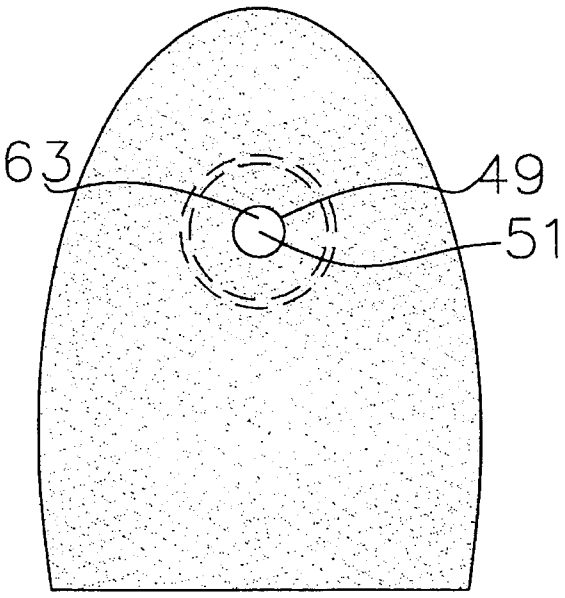
FIG. 5 is rear view of the second version of the present invention.
Figure 4:
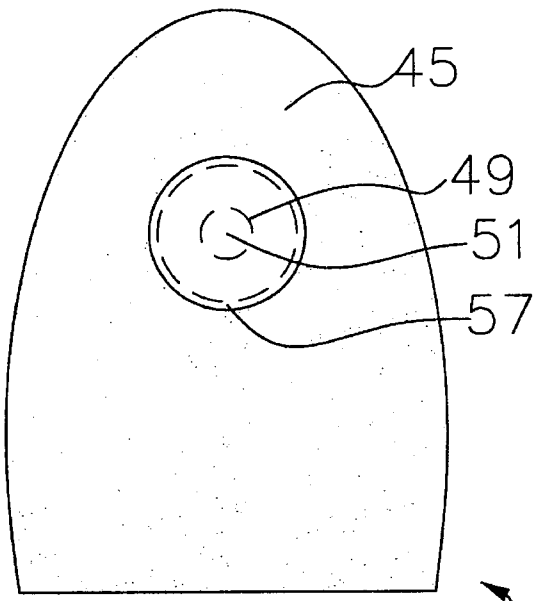
FIG. 4 is a front view of the second version of the present invention.
Figure 6:
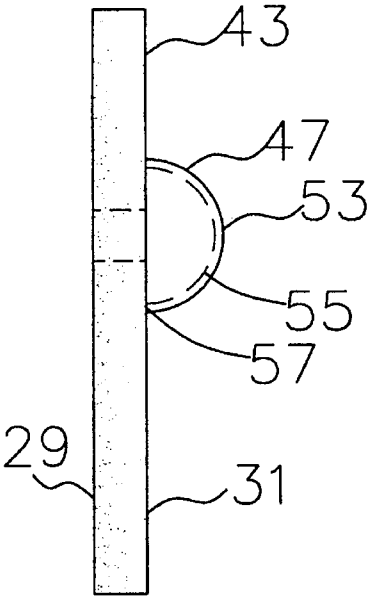
FIG. 6 is a side view of the second version of the present invention.
Figure 7:
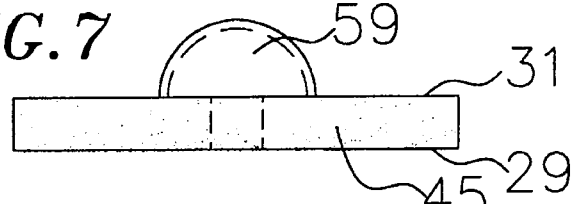
FIG. 7 is a top plan view of the second version the present invention.
Figure 8:
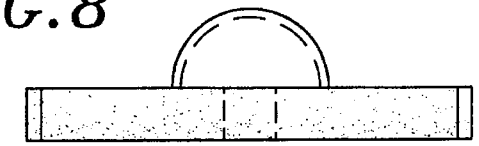
FIG. 8 is a bottom plan view of the second version the present invention.

FIG. 4 shows a second version 43 of the toilet blockage remover 17 which has a pad 45, a pump 47, and a cutout in the pad 49 forming a thru-hole of the pad 51. FIG. 5 shows the pad 45 of the second version 43 of the toilet blockage remover 17. FIG. 6 shows the pad 45 with a lower face 29 and an upper face 31, and the pump 47 with an outer wall 53, an inner wall 55 and a rim 57. The pump 47 is placed so the pump 47 completely covers over the cutout of the pad 49, so the inner wall 55 of the pump 47 and the upper face 31 of the pad 45 covered under the pump 47 creates a cavity 59 which has a thru-hole 51 through the pad 45. The rim 57 of the pump 47 is used to attach the pump 47 to the upper face 31 of the pad 45. An ideal method in attaching the rim 57 to the upper face 31 of the pad 45 is to bond the rim 57 on the upper face 31. To bond the rim 57, any strong adhesive will work well, including using glue, epoxy, or caulk. Other forms of mechanical fastening may also be used, such as nuts and bolts and screws. Similarly FIG. 7 and FIG. 8 show different view of the pad 45 with the lower face 29 and the upper face 31, and the pump 47 with the outer wall 53, the inner wall 55 and the rim 57.

In this second version 43 of the toilet blockage remover 17, the soft pad 45 is made of soft material that can provide a substantial seal of air tightness 35 between the mouth of the toilet opening 33 and the lower face 29 of the soft pad 45, and can provide structural support for additional weight to be placed on the invention. Therefore, in selecting the material for the pad 45, the air impermeability and the material strength are two factors to consider. An ideal material is a nylon or plastic foam that is cut to a size larger than the mouth of a toilet opening 33. However, the invention is not be limited to the use of the material specified as the only acceptable material.

One preferred improvement in the second version 43 of the invention is that the soft pad 45 can be treated on the upper face 31 of the soft pad 45 so the upper face 31 of the soft pad 45 will have substantially less softness than a portion of the lower face 29 of the soft pad 45. An example of such a hardening treatment may be using heat, chemical, or radiation to harden the material on and near the upper face 31 of the soft pad 45. It is believed that when a nylon foam is heat treated on one side, that side will become harder and stiffer than the untreated side.

Another means to make the soft pad 45 soft on one side and less soft on another side may be the use of the sputtering process. If the material is vapor deposited to form the soft pad 45, then the initially deposited material may be of more softness than the later deposited material. Another means is that as the material is vapor deposited to form the soft pad 45, the pressure used to deposit the initially deposited material may be less than the pressure used to deposit the later deposited material. Another method is that the pressure and the material may vary during the vapor depositing process so the softness of the soft pad 45 will vary smoothly across the thickness of the soft pad 45. The varying of the softness is illustrated in FIG. 6, FIG. 7, or FIG. 8, by the varying density of the dots representing the varying density of the material used.

The use of the sputtering technique is only one commonly known process that is able to provide a pad with two different softness within a single pad, and the invention is not be limited to the use of the process specified as the only acceptable method.

To enhance the air tightness of the substantial seal of air tightness 35 between the soft pad 45 and the mouth of the toilet opening 33, additional weight can be placed on the upper face 31 of the soft pad 45. The weight placed on the upper face 31 of the soft pad 45 could be anything that would increase the downward pressure on the invention evenly on and around the mouth of the toilet opening 33. The preferred form of the weight to be used will be those weights which have structural base wider than the mouth of the toilet opening 33 so the weight is distributed around the mouth of the toilet opening 33. If such weight with wide base is not available, then a hard board such as a wood panel may be placed on the soft pad 45 before the weight is placed upon the soft pad 45. A preferred method is to have the user 39 of the invention simply sit on the invention to supply the additional weight while using thighs to distribute most of body weight on to the mouth of the toilet opening 33.

The second version 43 of the invention is also to be used while the toilet water is being flushed. Therefore, a preferred method in using the invention is to have the user 39 place the invention on the mouth of the toilet opening 33 to completely cover the toilet opening 33, then the user 39 sits on the invention, then the user 39 flushes the water, and then the user 39 pumps the pump 47 several times while the water is filling the toilet bowl 41. As the air pressure within the toilet bowl 41 increases as the water level rises, and the air within the toilet bowl 41 is suddenly pushed and agitated in order to generate a shock wave of the pumping action, the impact of the air shock wave will be transmitted and will push the blockage away and remove the clog.

Figure 10:
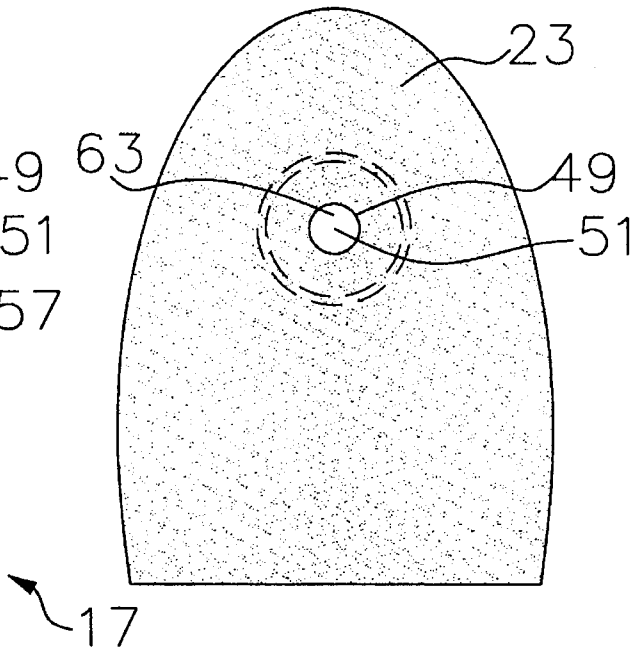
FIG. 10 is rear view of the third version of the present invention.
Figure 9:
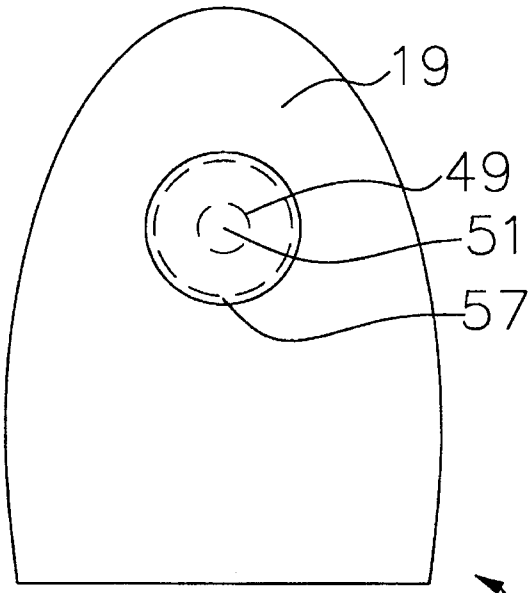
FIG. 9 is a front view of the third version of the present invention.
Figure 12:
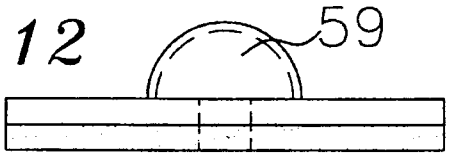
FIG. 12 is a top plan view of the third version the present invention.
Figure 11:
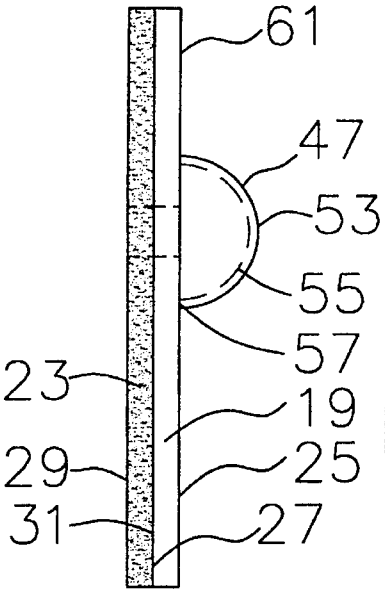
FIG. 11 is a side view of the third version of the present invention.
Figure 13:
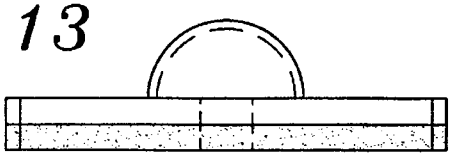
FIG. 13 is a bottom plan view of the third version the present invention.

FIG. 9 shows a third version 61 of the toilet blockage remover 17 which has the toilet seat cover 19, the pump 47, and the cutout 49 in the toilet seat cover 19 forming a thru-hole 51 of the toilet bowl cover 19. FIG. 10 shows the soft pad 23 and the thru-hole 51 of the soft pad 23 of the third version 61 of the toilet blockage remover 17. FIG. 11 shows the toilet seat cover 19 with the top side 25 and the bottom side 27, the soft pad 23 with a lower face 29 and an upper face 31, and the pump 47 with an outer wall 53, an inner wall 55 and a rim 57. The pump 47 is placed so the pump 47 completely covers over the cutout 49 of the toilet seat cover 19, so the inner wall 55 of the pump 47 and the top side 25 of the toilet seat cover 19 covered under the pump 47 creates a cavity 59 which has a thru-hole 51 through the toilet seat cover 19 and through the soft pad 23. The thru-hole 51 of the toilet seat cover 19 should substantially overlap the thru-hole of the soft pad 23 so the cavity 59 is open and accessible from the exterior of the toilet blockage remover 17. The rim 57 of the pump 47 is used to attach the pump 47 to the top side 25 of the toilet bowl cover 19. An ideal method in attaching the rim 57 to the top side 25 of the toilet bowl cover 19 is to bond the rim 57 on the top side 25. To bond the rim 57, any strong adhesive will work well, including using glue, epoxy, or caulk. Other forms of mechanical fastening may also be used, such as nuts and bolts and screws. Similarly FIG. 12 and FIG. 13 show different view of the toilet bowl cover 19, the soft pad 23, and the pump 47.

Similar to the first version 21, in the third version 61 of the toilet blockage remover 17, the upper face 31 of the soft pad 23 is attached to the bottom side 27 of the toilet bowl cover 19. An ideal means to attach the upper face 31 of the soft pad 23 to the bottom side 27 of the toilet bowl cover 19 is to bond two surfaces together using an adhesive, but any other method to tightly secure two surfaces together will be acceptable.

The pump 47 is attached to the top side 25 of the toilet bowl cover 19 so the pump 47 completely covers over the cutout 49 of the toilet bowl cover 19. The inner wall 55 of the pump 47 and the top side 25 of the toilet bowl cover 19 covered under the pump 47 creates a cavity 59 which has a cavity opening 63 through the toilet seat cover 19 and through the soft pad 23.

In the third version 61 of the invention, the soft pad 23 is made of substantially softer material than the toilet bowl cover 19. It is because the soft pad 23 is to be placed over a mouth of a toilet opening 33 with the lower face 29 of the soft pad 23 completely covering the mouth of the toilet opening 33 so that a substantial seal of air tightness 35 is created between the mouth of the toilet opening 33 and the lower face 29 of the soft pad 23. Therefore, in selecting the material for the soft pad 23, the air impermeability and the softness are two factors to consider. An ideal material is a soft foam or dense sponge that is cut to a size larger than the mouth of a toilet opening 33. However, the invention is not be limited to the use of the material specified as the only acceptable material.

The toilet bowl cover 19 should be made of stiffer material so it would be able to support any additional weight that may be placed upon to enhance the efficiency of the invention. A piece of plastic or wood in a shape of the toilet seat 37 would be adequate, but the invention is not to be limited to the use of plastic or wood as the only acceptable material.

To enhance the air tightness of the substantial seal of air tightness 35 between the soft pad 23 and the mouth of the toilet opening 33, an additional weight can be placed on the top side 25 of the toilet bowl cover 19. The weight placed on the top side 25 of the toilet bowl cover 19 could be anything that would increase the downward pressure on the invention evenly. A heavy book or a several books would be effective. However, the most preferred method is to have the user 39 of the invention simply sit on the invention to supply the additional weight.

The third version 61 of the invention is to be used while the toilet water is being flushed. Therefore, the most preferred method in using the third version 61 of the invention is to have the user 39 places the third version 61 of the invention on the mouth of the toilet opening 33 to completely cover the toilet opening 33, then the user 39 sits on the third version 61, then the user 39 flushes the water, and then the user 39 pumps the pump 47 several times while the water is filling the toilet bowl 41. As the air pressure within the toilet bowl 41 increases as the water level rises, and the air within the toilet bowl 41 is suddenly pushed and agitated in order to generate a shock wave of the pumping action, the impact of the air shock wave will be transmitted and will push the blockage away to remove the clog.

With the second version 43 and the third version 61 of the present invention, if the pump 47 is made of a material without sufficient elasticity, such as soft rubber, then the pump 47 can be used as the indicator that shows whether the blockage is removed or not. Because the invention works due to the increased pressure within the toilet bowl 41 as the water is flushed and fills the toilet bowl 41, once the blockage is removed, then the air pressure in the toilet bowl 41 returns to the normal atmospheric pressure. Therefore, if the pump 47 is made of flexible material which does not return to its original shape unless pressure is applied, then the result is that while the pressure is built up because of the blockage, the increased pressure within the toilet bowl 41 will push the pump outward to its original shape, and when the pressure is relieved because the blockage is removed, the normalized pressure within the toilet bowl 41 will not push the pump 47 outward to its original shape. Therefore, as the water is flushed, and while the pressure is built up, the pump 47 will be restored to its original shape so the user 39 may pump again, but as the blockage is removed and the pressure is normalized, the pump 47 will not return to its original shape, signaling the removal of the clog.

I believe the third version 61 of the invention without the non-elasticity pump to be the best version of the invention, mainly because of the ease in selecting the material for the pump 47. If so, then the user 39 may simply use the material used for pumps used in the "plumber's helper." However, with or without the elasticity in the pump 47, either version of the invention would operate at the highest efficiency.

Figure 15:
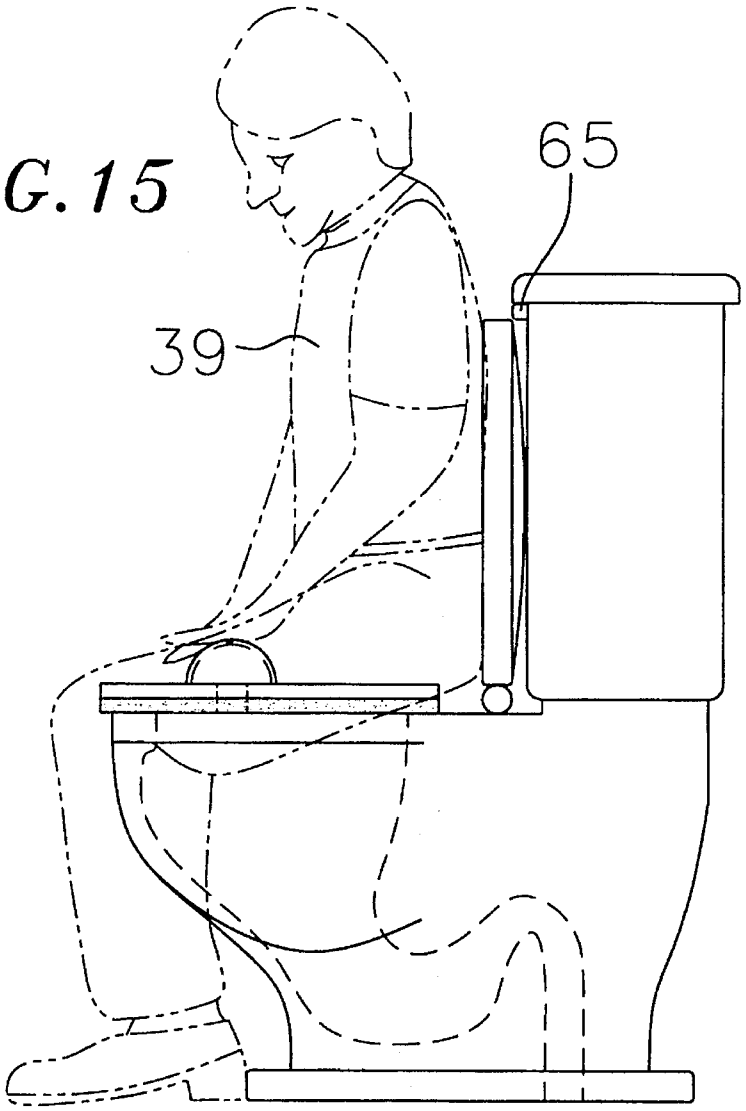
FIG. 15 is a front view of a person using the third version of the present invention while sitting on the invention.
Figure 14:
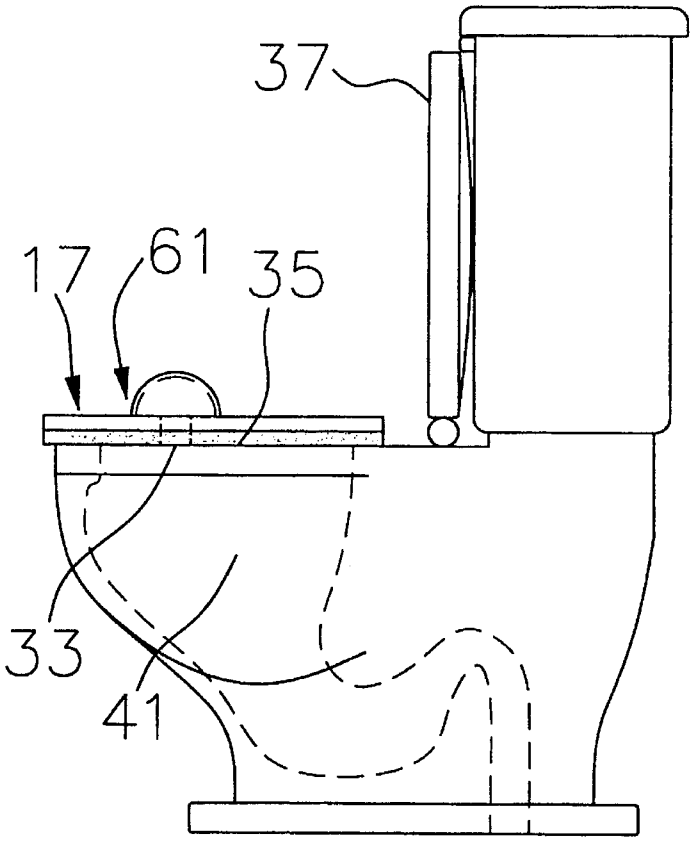
FIG. 14 is a front view of a conventional toilet with the third version of the present invention placed on the top of the toilet rim.
Figure 16:
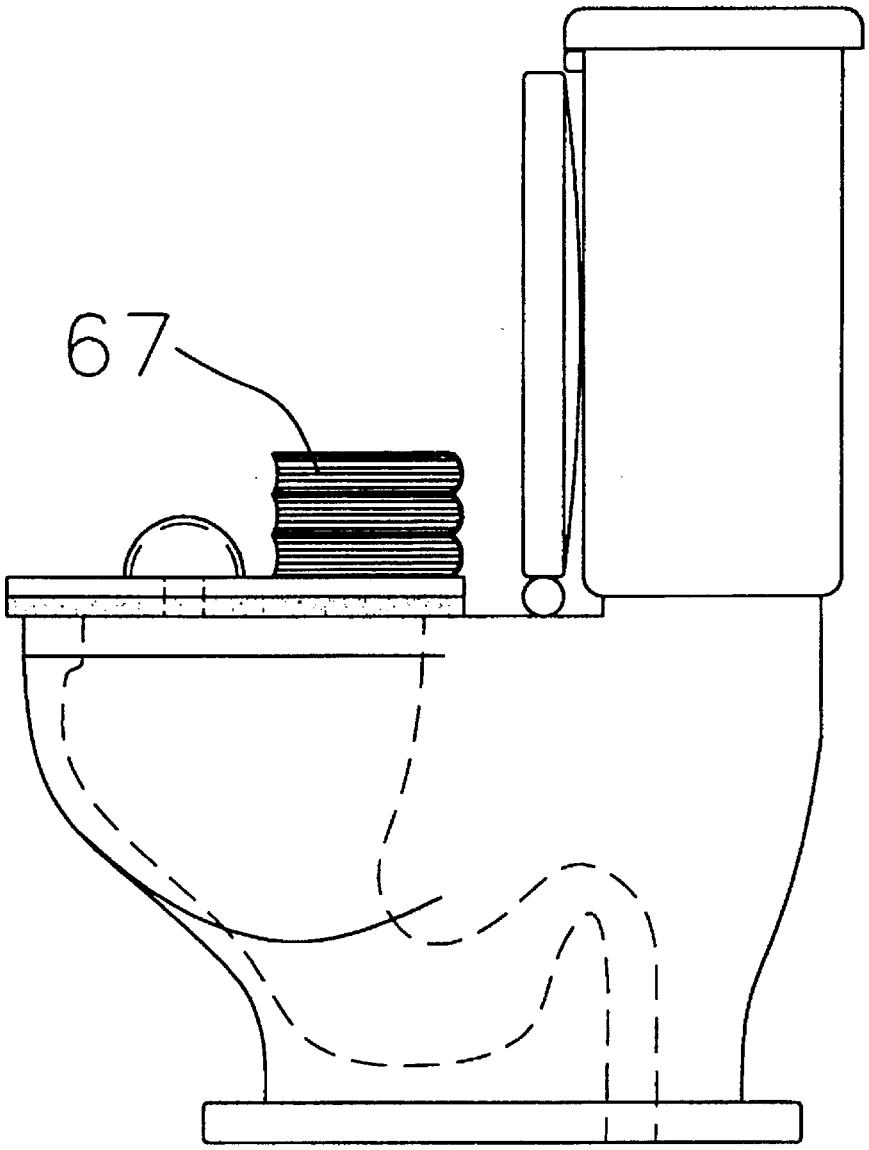
FIG. 16 is a front view of the third version of the present invention placed on the top toilet rim while a several books are used as an added weight.

FIG. 14 shows the third invention 61 of the toilet blockage remover 17 placed on the mouth of the toilet opening 33. FIG. 15 shows the user 39 sitting on the third invention 61 of the toilet blockage remover 17, pumping the pump 47, right after the user 39 has flushed the water with the toilet water flush handle 65. FIG. 16 shows the third invention 61 of the toilet blockage remover 17 being weighed down by a weight 67. In this illustration, the weight 67 is simply a several books stacked together to force down the toilet blockage remover 17. There may be a variety of items that could be used in lieu of books.

One of the advantages in using this invention is the simplicity. There are no clamps, fastening devices, a cover with a hole for the plunger, and a pump attached to an end of a long plunger. With one version of the invention, the user 39 simply places the invention over a toilet bowl 41 with a clog, and flush the water. With the second version 43 and the third version 61 of the invention, the user 39 simply places the invention over a toilet bowl 41 with a blockage, flushes the water, and pumps the pump 47 a several times as water accumulates within the toilet bowl 41.

Another advantage in using this invention is that the use of the invention is clean. Because there is no agitation of the water by the pump which is immersed, the splashes are controlled and are very limited. Because splashes are controlled, there are no mess. Even the cleaning of the invention after the use is often unnecessary as much of the water does not splash and does not touch the invention.

Although the present invention has been described in considerable detail with reference to certain preferred versions thereof, other versions are possible. For example, the cutout 49 in the soft pad 23 may be very large such that the soft pad 23 itself is only a ring around the perimeter on the lower face 29 generally conforming to the shape of the mouth of the toilet opening. Also, bonding is suggested to hold the bottom side 27 of the toilet seat cover 19 and the upper face 31 of the soft pad 23, but any other means to tightly secure two surfaces together will be just as effective, such as the use of nails, screws, nuts and bolts, gluing, and frictional hold. Therefore, the spirit and scope of the appended claims should not be limited to the description of the preferred embodiment or the preferred versions contained therein.

What I claim is:

1. A toilet blockage remover comprising:

a) a soft pad with an upper face and a lower face having a cutout through the soft pad forming a thru-hole of the soft pad;

b) a toilet bowl cover with a top side and a bottom side having a cutout through the toilet bowl cover forming a thru-hole of the toilet bowl cover, wherein the upper face of the soft pad is attached to the bottom side of the toilet bowl cover so that the thru-hole of the cover substantially overlaps with the thru-hole of the soft pad, and wherein the soft pad is made of substantially softer material than the toilet bowl cover wherein the toilet blockage remover adapted to be placed over a mouth of a toilet opening with the lower face of the soft pad completely covering the mouth of the toilet opening such that a substantial seal of air tightness is created between the mouth of the toilet opening and the lower face of the soft pad; and c) a pump having an inner wall, an outer wall, and a rim wherein the rim of the pump is attached to the top side of the toilet seat cover so the pump completely covers over the cutout of the toilet bowl cover creating a cavity with a cavity opening due to the thru-hole of the cover and the thru-hole of the soft pad.

2. The toilet blockage remover of claim 1 further comprising a weight placed on the top side of the toilet bowl cover so the seal of air tightness is improved.

3. The toilet blockage remover of claim 1 wherein the pump is made of a material with sufficient elasticity so that the pump returns to its original shape after being pressed without pressure being applied from the opposite side.

4. The toilet blockage remover of claim 3 further comprising a weight placed on the top side of the toilet bowl cover so the seal of air tightness is improved.

5. The toilet blockage remover of claim 1 wherein the pump is made of a material without sufficient elasticity so that the pump does not return to its original shape after being pressed without pressure being applied from the opposite side.

6. The toilet blockage remover of claim 5 further comprising a weight placed on the top side of the toilet bowl cover so the seal of air tightness is improved.

7. A toilet blockage remover comprising:

a) a soft pad with an upper face and a lower face having a cutout through the soft pad forming a thru-hole of the soft pad; and b) a pump having an inner wall, an outer wall, and a rim wherein the rim of the pump is attached to the upper face of the soft pad so the pump completely covers over the cutout of the soft pad creating a cavity with a cavity opening due to the thru-hole of the soft pad, wherein when the soft pad is placed over a mouth of a toilet opening with the lower face of the soft pad completely covering the mouth of the toilet opening, a substantial seal of air tightness is created between the mouth of the toilet opening and the lower face of the soft pad.

8. The toilet blockage remover of claim 7 wherein the soft pad is made of a material wherein a portion of the upper face of the soft pad is made of the material that has substantially less softness than a portion of the lower face of the soft pad.

9. The toilet blockage remover of claim 8 wherein the softness of the material vary smoothly across the thickness of the soft pad.

10. The toilet blockage remover of claim 9 wherein the pump is made of a material without sufficient elasticity so that the pump does not return to its original shape after being pressed without pressure being applied from the opposite side.

11. The toilet blockage remover of claim 10 further comprising a weight placed on the upper face of the soft pad so the seal of air tightness is improved.

12. The toilet blockage remover of claim 9 further comprising a weight placed on the upper face of the soft pad so the seal of air tightness is improved.

13. The toilet blockage remover of claim 8 wherein the pump is made of a material without sufficient elasticity so that the pump does not return to its original shape after being pressed without pressure being applied from the opposite side.

14. The toilet blockage remover of claim 13 further comprising a weight placed on the upper face of the soft pad so the seal of air tightness is improved.

* * * * *